US007954547B2

(12) United States Patent
Lowe et al.

(10) Patent No.: US 7,954,547 B2
(45) Date of Patent: Jun. 7, 2011

(54) GAS FLOW SYSTEM

(75) Inventors: Kenneth W. Lowe, Calgary (CA); Javier Alfonso Becaria Valero, Calgary (CA); Clarence Robert Dyck, Medicine Hat (CA)

(73) Assignee: EnCana Corporation, Calgary, Alberta (CA)

( * ) Notice: Subject to any disclaimer, the term of this patent is extended or adjusted under 35 U.S.C. 154(b) by 91 days.

(21) Appl. No.: 12/231,483

(22) Filed: Sep. 3, 2008

(65) Prior Publication Data

US 2010/0051267 A1 Mar. 4, 2010

(51) Int. Cl.
*E21B 44/00* (2006.01)

(52) U.S. Cl. ..... 166/250.15; 166/53

(58) Field of Classification Search ..... 166/370, 166/372, 117.5, 105, 313, 68, 250.15
See application file for complete search history.

(56) References Cited

U.S. PATENT DOCUMENTS

| | | | | |
|---|---|---|---|---|
| 4,596,516 | A | 6/1986 | Scott et al. | |
| 5,033,550 | A | 7/1991 | Johnson et al. | |
| 5,957,199 | A * | 9/1999 | McLean et al. | 166/250.15 |
| 6,629,566 | B2 | 10/2003 | Liknes | |
| 6,991,034 | B2 * | 1/2006 | Wilde | 166/250.15 |
| 7,204,314 | B2 | 4/2007 | Lauritzen et al. | |
| 2005/0039813 | A1 | 2/2005 | Dougherty, Sr. et al. | |
| 2005/0053503 | A1 | 3/2005 | Gallant | |
| 2005/0155769 | A1 | 7/2005 | Sherwood et al. | |
| 2005/0217859 | A1 | 10/2005 | Hartman et al. | |
| 2005/0274527 | A1 | 12/2005 | Misselbrook et al. | |
| 2006/0045767 | A1 | 3/2006 | Liknes | |
| 2006/0045781 | A1 | 3/2006 | Liknes | |
| 2006/0065390 | A1 | 3/2006 | Amies et al. | |
| 2006/0076139 | A1 | 4/2006 | Conrad | |
| 2006/0102346 | A1 | 5/2006 | Casey | |
| 2006/0124298 | A1 | 6/2006 | Geler | |
| 2006/0144597 | A1 | 7/2006 | Casey | |
| 2006/0185840 | A1 | 8/2006 | Conrad | |

(Continued)

OTHER PUBLICATIONS

Turner, R.G. et al.: "Analysis and Prediction of Minimum flow Rate for the Continuous Removal of Liquids from Gas Wells," Journal of Petroleum Technology, Nov. 1969, pp. 1475-1482.
Coleman, S.B. et al, "A New Look at Predicting Gas- Well Load-Up," Journal of Petroleum Technology, Mar. 1991 pp. 329-333.

(Continued)

*Primary Examiner* — Kenneth Thompson
*Assistant Examiner* — James G Sayre
(74) *Attorney, Agent, or Firm* — Dilworth & Barrese, LLP.

(57) ABSTRACT

A gas flow system for removing a liquid from a well bore and allowing for gas production is provided. The gas flow system comprises a casing in the well bore for allowing flow of the liquid and gas; a tubing string in the casing for allowing flow of the liquid and gas; pressure measurement devices for use in determining a rate of liquid influx into the well bore; a casing control valve moveable between various positions ranging from fully open to fully closed for controlling flow through the casing; a tubing control valve moveable between various positions ranging from fully open to fully closed for controlling flow through the tubing; and flow measurement devices for determining the rate of flow through the tubing and the total rate of flow. The system is switchable between a current production phase and an alternate production phase based on the determined rate of liquid influx, a tubing critical velocity and a gas flow rate through the tubing, wherein switching from a current production phase to an alternate production phase results in the either or both of a decrease in liquid build-up in the well bore and an increase in gas production rate and wherein the current production phase differs from the alternate production phase.

6 Claims, 6 Drawing Sheets

U.S. PATENT DOCUMENTS

2007/0012442 A1* 1/2007 Hearn ..... 166/250.15

OTHER PUBLICATIONS

Martinez et al. "Coiled Tubing Velocity Strings-Expanding the Cases", 1998 SPE/ ICoTA Coiled Tubing Roundtable, Apr. 15-16, 1998, pp. 111-117.

Harms et al. "Better Results Using Integrated Production Models for Gas Wells," 2005 SPE Production and Operations Symposium, Apr. 17-19, 2005, pp. 1-7.

Osman et al, "Prediction of Critical Gas Flow Rate for Gas Well Unloading" 10th Abu Dhabi International Petroleum Exhibition and Conference, Oct. 13-16, 2002, pp. 1-5.

* cited by examiner

Figure 2: The vertical line represents the critical flow rate. Left of the critical rate the sand face pressure increases due to slug flow; to the right the sand face pressure increases due to frictional pressure losses from increasing gas velocities

Figure 3: Operational area for switch valve and siphon string phases.

Figure 4: Graph showing the benefits of velocity string mode (phase 3) and Slipstreaming (phase 2)

Figure 5: Graph showing the benefits that the switch valve mode provided to a dead well.

GAS FLOW SYSTEM

FIELD OF INVENTION

This invention relates to gas wells and more particularly, to methods and systems for removing liquids from gas producing wells.

BACKGROUND

Wells that produce gas and have concurrent production of liquids such as water, oil or condensates, are often incapable of clearing these liquids from the well bore. This is especially true in depleted reservoirs and low-rate gas wells. Liquids accumulate in the well bore as gas is produced. Accumulated liquid exerts backpressure on the producing formation such that flow of gas is reduced or completely restricted.

Existing technology for dewatering of gas wells can be divided into two general categories: high cost and low cost. For the purposes of this specification the term dewatering encompasses the removal of liquids including but not limited to water.

Typical high cost dewatering methods for reducing liquid accumulation in the well bore and reestablishing a viable gas production rate usually involve external energy sources to power a pumping technology such as down-hole pumps. One problem with external energy sources such as down-hole pumps is that many pumping methods are labor intensive, require regular attention and generally use expensive equipment to provide an external source of lifting capacity to clear the well bore of the liquids. As a result, these technologies are cost prohibitive, and are often not economically viable for low production wells.

Low cost dewatering technologies have a narrow operating range, and must be suited to each individual well based on well characteristics such as water gas ratio (WGR), well pressure, and gas flow rate. This information is often unavailable, and can be highly variable over time. Low cost technologies generally require regular attention from operations staff which can be problematic in areas of limited or restricted lease access. The narrow operating range of low cost dewatering technologies means that they usually fail when well conditions change in such a way that they are outside of the operating range. Failure of these technologies results in down time and lost production, and can also require attention from operations staff in order to resume production.

A need therefore exists for a well dewatering method and system that overcomes at least one of the above mentioned shortcomings associated with existing technologies or at least overcomes one shortcoming inherent to existing and potential well dewatering systems further to those described above.

SUMMARY

A gas flow system for removing a liquid from a gas well bore and allowing for gas production and a method of dewatering a gas well while allowing for gas production are provided. The gas flow system switches between various production phases based on the conditions of the gas well to ensure that liquid build up is reduced or prevented while gas flow is maintained. The production phase may be selected based on the determined influx rate of liquid in addition to comparing a tubing critical velocity of a tubing string of the system and a flow rate through the tubing string. In one embodiment, when the flow rate through the tubing string decreases below a preset threshold, for example the tubing critical velocity, the system automatically switches from a current product phase to an alternate production phase more suitable for effecting dewatering of the gas well bore and allowing for gas production. Switching of the current production phase to the alternate production phase may be based on different measured and calculated conditions or a combination of measured and calculated conditions of the gas well. An Evaluation Mode may be used to determine the well conditions such as rate of liquid influx.

In one illustrative embodiment, there is provided a gas flow system for removing a liquid from a well bore and allowing for gas production, the system comprising:

- a casing in the well bore for allowing flow of the liquid and gas;
- a tubing string in the casing for allowing flow of the liquid and gas;
- pressure measurement devices for use in determining a rate of liquid influx into the well bore and for monitoring pressure build ups;
- a casing control valve moveable between various positions ranging from fully open to fully closed for controlling flow through the casing;
- a tubing control valve moveable between various positions ranging from fully open to fully closed for controlling flow through the tubing;
- flow measurement devices for determining the rate of flow through the tubing and the total rate of flow;
- the system switchable between a current production phase and an alternate production phase based on the determined rate of liquid influx, a tubing critical velocity and a gas flow rate through the tubing, wherein switching from a current production phase to an alternate production phase results in the either or both of a decrease in liquid build-up in the well bore and an increase in gas production rate and wherein the current production phase differs from the alternate production phase.

In another illustrative embodiment, there is provided a method of dewatering a gas well while allowing for gas production, the gas well comprising:

- a casing in the well bore for allowing flow of the liquid and gas;
- a tubing string in the casing for allowing flow of the liquid and gas;
- measurement devices for determining a rate of liquid influx into the well bore and a tubing critical velocity;
- a casing control valve moveable between various positions ranging from fully open and fully closed for controlling flow through the casing;
- a tubing control valve moveable between various positions ranging from fully open and fully closed for controlling flow through the tubing;
- flow measurement devices for determining the rate of flow through the tubing and the total rate of flow;
- the method comprising the steps of:
  - a) determining the rate of liquid influx into the well bore;
  - b) determining the critical tubing velocity and comparing the rate of flow through the tubing with the critical tubing velocity; and
  - c) switching a current production phase to an alternate production phase if the rate of flow through the tubing is above or below a specified velocity range encompassing the critical tubing velocity, or the rate of liquid influx is resulting in liquid build-up in the well bore.

DETAILED DESCRIPTION

Figure 1:
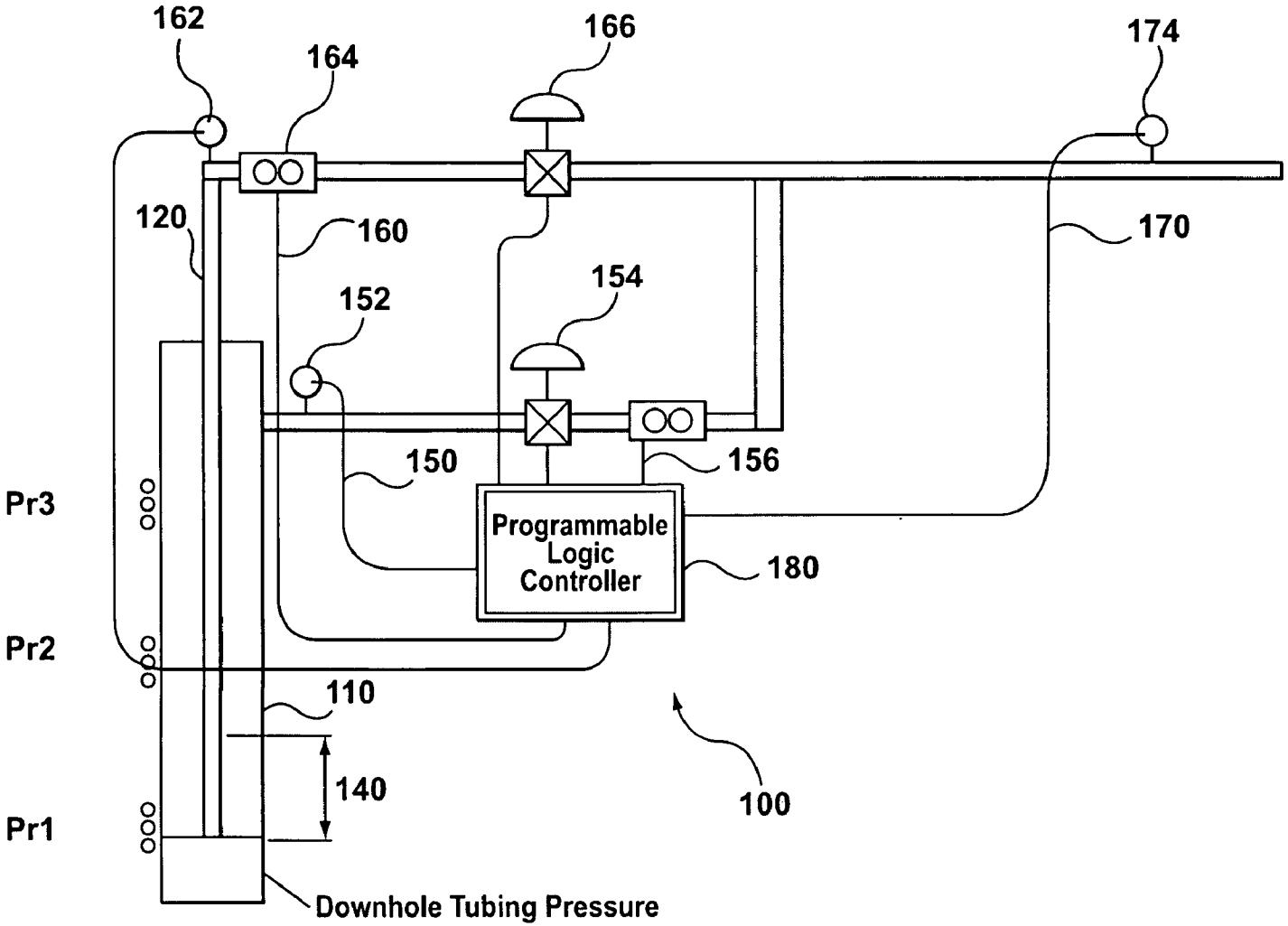
FIG. 1 is a schematic view of an illustrative embodiment of a gas flow system.

FIG. 1 is an illustrative embodiment of a gas flow system in a well bore, the gas flow system shown generally at 100. The gas flow system is comprised of a casing 110 in a well bore. The casing 110 has an internal diameter, CID, through which gas and liquid may flow. A tubing string 120 is set in the casing 110 and has an internal diameter, TID, through which both gas and liquid may flow and an external diameter, TED. Pressure measurement devices, such as a tubing pressure device 162, a casing pressure device 152 and a line pressure device 174 in communication with a well flowline 170, are used to determine a rate of liquid influx into the well bore and for monitoring pressure build ups. A tubing control valve 166 and a casing control valve 154 are used for controlling flow through the tubing string 120 and a casing flowline 150, respectively. A tubing flow meter 164 and a casing flow meter 156 are used for measuring gas tubing flow and casing gas flow, respectively.

A programmable logic controller (PLC) 180 may be used to process the measurements taken from the pressure measurement devices and the flow meters and for controlling the tubing control valve 166 and the casing control valve 154 based on predetermined criteria as will be discussed in more detail further below. The PLC 180 may continuously evaluate well conditions and select from one of a number of production phases, which suits the evaluated well conditions.

The gas flow system 100 uses and implements a number of production phases based on the conditions of the gas well and switches between phases as conditions in the gas well changes thereby allowing for gas production and dewatering of the gas well without the need for substitution or addition of components during operation. This ability to switch between production phases based on the conditions of the gas well results in the minimizing and even elimination of downtime due to liquid accumulation in the gas well, minimization of attention by operations staff after installation and setup, and the avoidance of high cost external power source equipment such as down-hole pumps.

The system 100 uses an Evaluation mode that determines the rate of liquid influx. Based on the determined rate of liquid influx together with gas production conditions, the system 100 can move between various production phases that provide for water removal and gas production that are more suited to the current gas well conditions, thereby providing a wider operating range than each production phase provides individually. This is beneficial as the rate of liquid influx changes over time as does the gas production rate. More efficient gas production is achieved when the backpressure on the well is minimized.

The production phases include but are not limited to:

Phase 1) Casing flow with auto cleanout;
Phase 2) Slipstreaming;
Phase 3) Siphon String/Tubing Flow; and
Phase 4) Switching Valves.

Each of these production phases will be discussed in more detail below.

By providing a system 100 that integrates at least two of the production phases, the system is able to provide extended well life and increased gas production for liquid loaded wells. The system is particularly applicable for shallow and coal bed methane (CBM) wells that produce low and moderate volumes of water that restrict production by increasing sand face pressure, as these wells typically require less energy and the system 100 typically runs on reservoir energy. The system 100 can also be used in deeper, high liquid production, and high productivity wells.

A suitable production phase may be determined based on the gas and water influx rates and a critical rate. The tubing string 120 set in the well bore is used to transfer down hole pressure and the associated water level to the surface. By using the change in the pressure difference over time between the tubing surface pressure and the casing surface pressure, the rate of water influx can be determined and a desirable or suitable production phase that will provide ideal or suitable gas production may be selected.

One example of a method of determining the rate of influx in the Evaluation Mode is as follows. The well bore is cleaned out by opening the tubing control valve 166 and closing the casing control valve 154. This will flush any liquid that is in the well bore out until the liquid level is at the tubing-liquid interface. The tubing control valve 166 is then shut. The static gas column in the tubing 120 will then provide the downhole tubing pressure. This downhole tubing pressure is quantified by a tubing pressure measurement device 162 plus the gas gradient, where the gas gradient, as is known in the industry, is a measure of the pressure exerted by the column of gas in the well bore and is commonly measured in kPa/m. As a result, for example, for every meter moved down in the well bore, the pressure increases by 0.57 kPa. Then, the casing control valve 154 is opened and allows gas to be produced up the well annulus into the casing flow line 150. If there is water influx into the well bore, the differential liquid head 140 will increase. The result is a direct increase in the tubing surface pressure. The change in the pressure difference between the tubing 120 and the casing 110 over time will provide the rate of liquid influx. The liquid influx rate is determined by calculating the column of liquid corresponding to the observed differential pressure (Tubing Pressure—Casing Pressure) multiplied by the annular cross-sectional area between the CID and the TED and then divided by the lapse of time when the incremental pressure occurred. A general formula for calculating the rate of liquid influx is:

$$\text{Liquid_Influx} = \frac{d(P_{tub} - P_{csg})}{dt} * \frac{A_{Annular}}{\rho g} (\text{m}^3/\text{s})$$

where:

Ptub/csg=Tubing surface and casing surface pressures,
t=time (sec),
$A_{annular}$=Cross sectional area of the annulus,
ρ=density,
and g=acceleration due to gravity.

The critical rate is a parameter that defines transitions between the production phases. It may be defined as the minimum gas flow rate required to suspend a droplet of liquid (water and/or condensate for example) in a stream of gas. This condition occurs when the drag force of the gas flowing upwards balances out the force of gravity acting downwards on the droplet of liquid. Any additional gas will force the droplet of liquid to travel upwards along with the stream of gas thereby minimizing the liquid that accumulates in the well bore to cause liquid loading.

The objective of the system 100 is to keep the well from loading with liquids, while achieving or increasing gas production. Maintaining critical gas flow rate will ensure that the well does not load with liquids. Gas production may be maximized by implementing the production phase of Casing flow, Slipstreaming, or Tubing flow if the gas flow rate is greater than the critical rate. Conversely, if the well is flowing below the critical rate, a liquid loading condition will prevail, and the Switching valves production phase may be implemented to unload the liquid from the well.

The results of the water influx determination and the critical flow rate may be used to determine the suitable production phase for the gas well. In this way, the system 100 including the PLC 180 may monitor and select the most suitable production phase for the well without input from operations staff.

The four main production phases will now be discussed in more detail.

Phase 1) Casing Flow with Auto Cleanout

Casing flow is the conventional method for producing gas from a gas well. The gas is allowed to flow up the annulus of the production casing 110. When operating in the casing flow production phase, one of two optional sub-phases may be selected. The first sub-phase is selected when the gas well has sufficient pressure and flow rate to naturally lift any produced liquids to the surface. The second sub-phase occurs when liquid accumulates at the bottom of the gas well while the well is producing up the casing 110 at a controlled rate. The system 100 monitors the differential pressure between the casing 110 and the tubing 120 and can alleviate this problem. When the differential pressure reaches a preset limit, liquid flow may be diverted to the tubing 120 to flush the built up liquid from the wellbore to increase gas production.

This production phase is applicable to gas wells having conditions with low liquid influx and high gas production rates. The gas is allowed to flow up the casing 110 while liquids accumulate in the wellbore. The benefit of this production phase is reduced frictional pressure losses compared to when the gas is flowing up the tubing 120. The larger cross sectional area of the casing 110 reduces the gas velocity and in turn reduces the frictional pressure loss.

The preset limit may be determined initially by empirical correlation and may be tuned to the optimum well response by reviewing the operating performance and production flow volumes.

Phase 2) Slipstreaming (Co-Current Casing and Tubing Flow)

Slipstreaming is a technique that maintains critical velocity in the tubing by choking the casing gas flow in the annulus allowing both gas and entrained liquid to be produced up the tubing 120, and gas to flow up the casing 110. The tubing flow meter 164 in the tubing 120 and the casing gas flow meter 156 will calculate the gas velocity through the cross-section areas. The PLC 180 is set to keep the gas velocity higher than the Turner critical velocity, also referred to as the critical velocity, in the tubing.

An illustrative sequence of events occurring with this production phase is described:

1) The total gas stream is allowed to flow through the tubing 120. The critical velocity for the tubing 120 is evaluated and the valves 166 and 154 are controlled to maintain the tubing flow such that the gas velocity is at or above the critical velocity. This may be monitored and controlled by the PLC 180.

2) When the tubing flow approaches critical velocity, the casing valve 154 is opened to divert a portion of the total flow to the annulus until the tubing flow is just above the Turner critical velocity. This procedure may be automatically executed by the PLC 180 that takes the information from the flow meters 156 and 164 and activates the casing control valve 154 on the casing side to control the flow through the casing 110.

3) If the tubing flow drops below critical velocity, the casing stream is pinched out until the casing 110 is fully closed and all of the gas flows through the tubing 120. The cycle will then repeat.

4) The well will keep the water out of the hole as long as the tubing gas velocity remains higher than the critical velocity.

If the liquid is not being effectively removed from the well bore, the tubing flow will decrease and additional back pressure is applied to the casing by closing the casing valve 154. The PLC 180 may automatically attempt to optimize the gas well in this mode by gradually opening the casing valve 154 until the stabilized tubing flow is achieved with the lowest casing back pressure.

Ideal gas production with continuous liquid unloading from the gas well can be maintained and intermittent flow regimes that are associated with liquid loading in the well bore may be avoided. Initial set points may be established with empirical correlations that can be determined using evaluation phase data. The critical velocity set point can be established by a Turner correlation. An example of the correlation is shown below $$Vg = \frac{k * \sigma^{0.25} * (\rho_L - \rho_G)^{0.25}}{\rho_G^{0.5}}$$

where

Vg=gas velocity ft/s k (Turner Coefficient)=1.596

σ=Liquid Surface Tension, dynes/cm $\rho_G$=Gas Density at BH conditions, lb/ft$^3$.

$\rho_L$=Liquid Density, lb/ft3

Gas production from tubing and casing pressure should be monitored when using the Slipstream Valve System production phase. Critical velocities for all cross-section areas, including annulus and tubing velocities should be determined to define the proper tubing diameter for a given casing diameter. The installed tubing diameter should be defined with the current and anticipated gas production and liquid production rate. The tubing is designed to unload the maximum projected liquid volume for a given volume of gas.

When the gas well is operating in a stable slipstreaming mode, the PLC 180 will attempt to self-optimize from initial set parameters by reducing casing back pressure until the tubing velocity drops below the critical velocity. To determine if the water influx rate changes as the well is produced, the PLC 180 may measure the influx rate, using the method for example as outlined above, on a periodic basis.

A variation of this technique using a differential pressure controller on the casing control valve 154 that will control the tubing critical velocity may alternatively be implemented. The differential pressure controller will provide a lower cost system that will not automatically optimize for changes in flow condition. Manual intervention is required to tune the differential controller as it does not provide a complete measurement of tubing critical velocity. This will partially bypass the PLC 180 for the slipstream control, but the Evaluation mode and casing flow data may still be used to determine if slipstreaming is the optimum production phase of the well based on the current conditions.

As the well depletes, the bottom hole pressure will decrease and the slipstreaming controls will automatically close the casing valve until all of the gas flow is routed into the tubing 120.

Some features of utilizing a slipstream production phase are:

1. Extended flow envelope provided by a small siphon string as only one siphon string size is required through the total life of the gas well. A variation in gas velocity is achieved when the flowing cross-section area is reduced by changing the tubing diameter for a smaller one by gradually closing the casing valve until all gas is forced to flow through the tubing 120.

Figure 2:
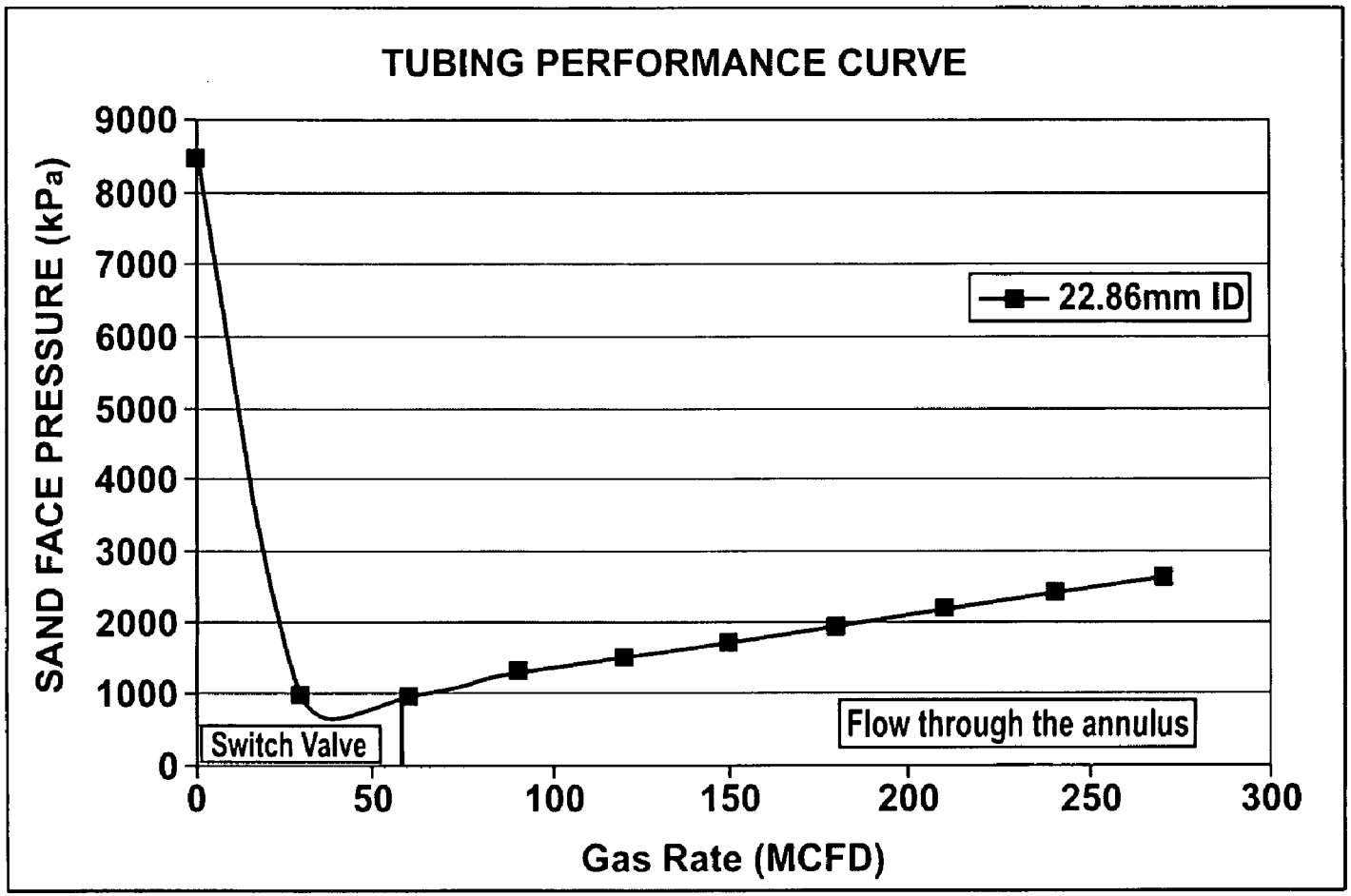
FIG. 2 is a graph illustrating Tubing Performance in a Slipstreaming production phase with sand face pressure v. gas flow rate. The vertical line represents the critical flow rate. Left of the critical rate the sand face pressure increases due to hydrostatic pressure; to the right the sand face pressure increases due to frictional pressure losses from increasing gas velocities.

2. Reduced operating sandface pressure when compared to conventional velocity string sizing. This is because a high quality performance of small diameter tubing (such as siphon strings) occurs when the gas is flowing at a velocity close to the Turner critical velocity. At gas rates lower than the critical velocity, elongated bubbles of gas (Taylor Bubbles) form and travel with the liquids to the surface in a slug flow regime. The longer the bubbles, the lower the hydrostatic pressure applied to the sandface, and the better the gas well performs. Increasing gas rates will cause the bubble to occupy the entire length of the tubing until critical velocity is reached and the water flows as droplets. Further increasing the velocity beyond the critical rate causes increasing frictional pressure losses which lessen the performance of the tubing string as outlined in the graph of FIG. 2.

3. Low frictional pressure losses when flowing up the casing. Since a small diameter tubing 120 is used to unload the liquid from the gas well and the rest of the available gas is produced up the annulus of the casing 110, the gas suffers minimal friction pressure losses. The fluid flow in the annulus is generally considered to be single phase flow (gas only) meaning that, in a vertical well, the effect of friction will be determined by the velocity of the flow. The larger cross sectional area of the annulus means that the velocity of the gas is low (Gas velocity equals gas flow rate divided by cross sectional area, meaning high cross sectional area gives low velocity), and thus the frictional pressure losses are low compared to tubing flow. For example, gas wells that are flowing at two times the critical gas rate are candidates for slipstreaming. High permeability formations with high productive indices are more likely to succeed with slipstreaming. However, the system 100 operating in the slipstream production phase has been successfully tested in fractured formation gas wells where the permeability is low.

Phase 3) Siphon String or Tubing Flow

When the gas well has depleted to the point where slipstreaming is no longer viable, the system 100 may initiate the siphon string production phase and direct all flow of the liquids up the tubing 120 by default. In the siphon string production phase the casing valve is completely closed and all the gas is flowing up the production tubing 120. The gas well may remain in this mode until the flow velocity increases or decreases outside a specified range, in which case the system 100 may switch to slipstreaming or switching valves mode, respectively.

As the well is produced, a periodic Evaluation mode and/or casing flow test may be performed to determine if the liquid influx rate has changed and if there is a new more suitable production phase for the gas well based on the current conditions.

Figure 3:
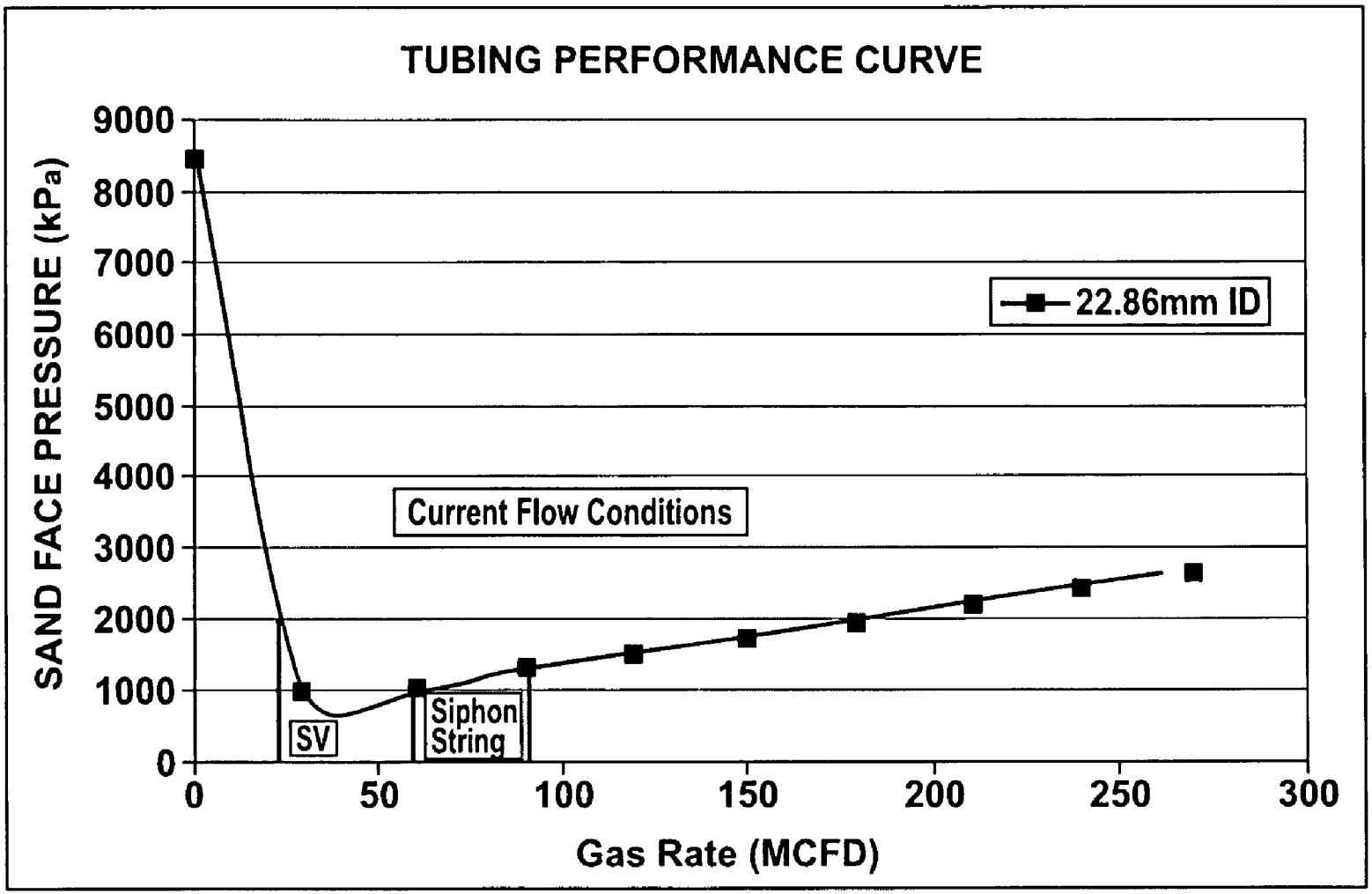
FIG. 3 is a graph illustrating Tubing Performance in a Siphon String production phase with sand face pressure v. gas flow rate showing an operational area for switching valves and siphon string phases.

Continued depletion of the gas reservoir will cause the gas flow rate to drop below the critical velocity and the well will load with liquid. Optionally, the switching valves production phase may begin when this happens. FIG. 3 shows a critical velocity limit in a small tubing diameter and the operational area for the tubing (siphon string) and the switching valves production phases.

Phase 4) Switching Valves

Switching valves is an existing technology and comprises operating the tubing control valve 166 and the casing control valve 154 in an intermittent manner. An illustrative cycle is described as follows:

1. Equalization: A well under liquid loading condition will show a high casing and low tubing pressures. The first step in dewatering and providing for gas production is to equalize pressures in the tubing 120 and the casing 110 by opening a valve that communicates the casing 110 with the tubing 120. This will allow the column of liquid in the tubing 120 and the annulus of the casing 110 to be a the same level.

2. Unloading the gas well: Once the pressures are stabilized, the tubing 120 is opened to production. An instantaneous expansion of the gas in the tubing 120 and annulus 110 generates enough kinetic energy to move the column of liquid to the surface. The gas pushing and carrying the liquid is produced until the pressure is released and the gas velocity nears the critical value.

3. Shut in the well: Once the gas has been produced, the gas well is shut in again and the pressure is allowed to build up in the annulus and the process is repeated.

Some limitations of the Switching valves production phase are the liquid influx from the formation and the gas productivity. A delicate balance between gas pressure build up and liquid accumulation can be achieved in order for this technology to be successful. High gas to liquid ratios are preferable.

EXAMPLES

1. Siphon String/Slipstreaming Transition

Figure 4:
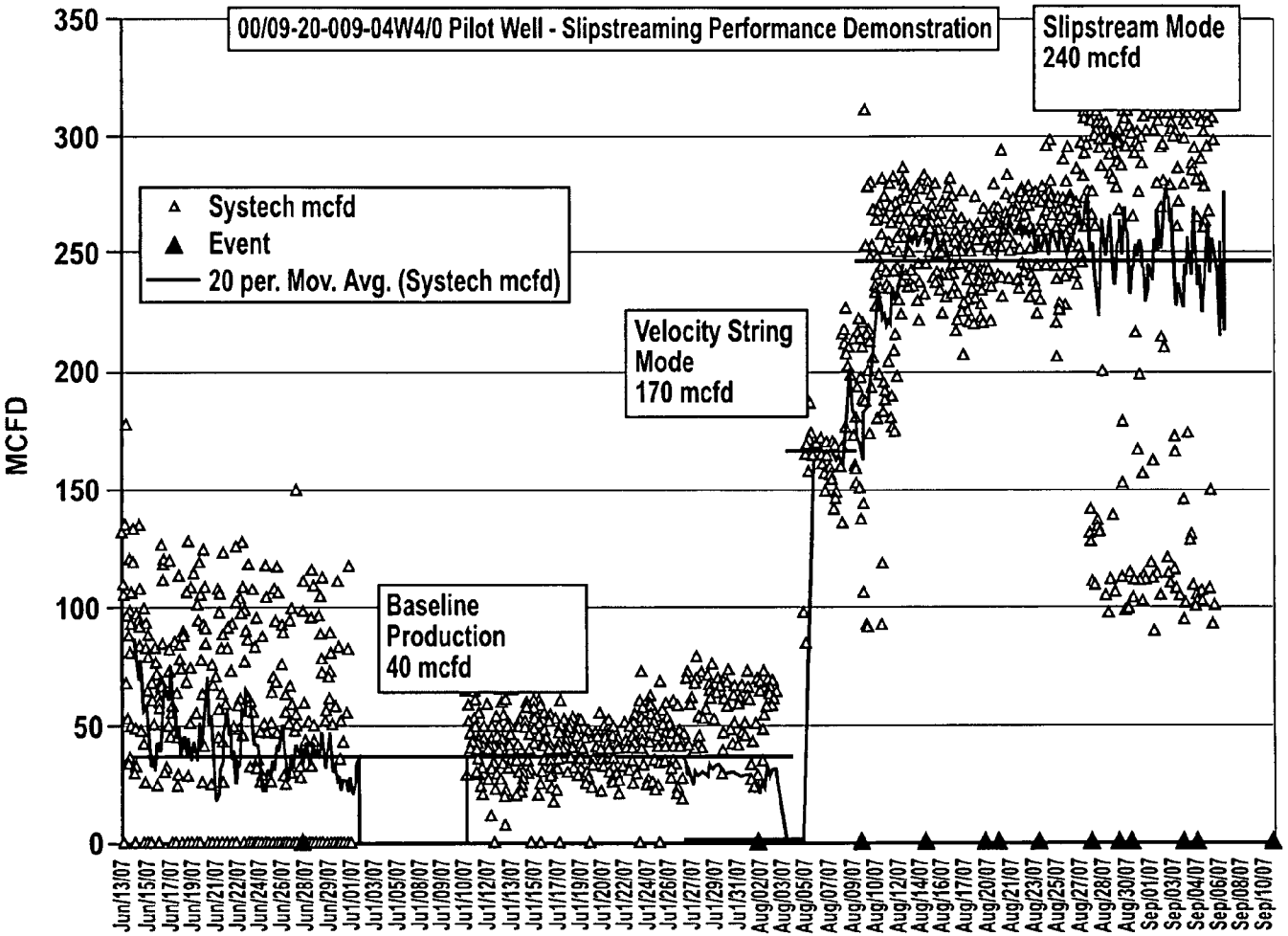
FIG. 4 is a graph presenting data collected from a pilot system illustrating the benefits of siphon string to slipstreaming production phase transition.

FIG. 4 is a graph of data taken from pilot systems in the Medicine Hat Area.

In this example the small siphon string diameter created a restricted flow. Once the slipstreaming system was installed the well was able to produce through the casing an additional 16 MCFD of gas. The new flow condition stabilized at 79 MCFD approx. In this case the critical velocity set for the 0.7" ID tubing was 45 MCFD. The rest of the gas was flowing through the annulus.

This technology ended up producing the total amount of gas only through the tubing once the gas production reached the critical velocity value associated with the 0.7" ID tubing size (45 MCFD). The siphon string flow will eventually be transformed to intermittent flow as illustrated in the next example.

2. Switching Valves/Slipstreaming Transition

Figure 5:
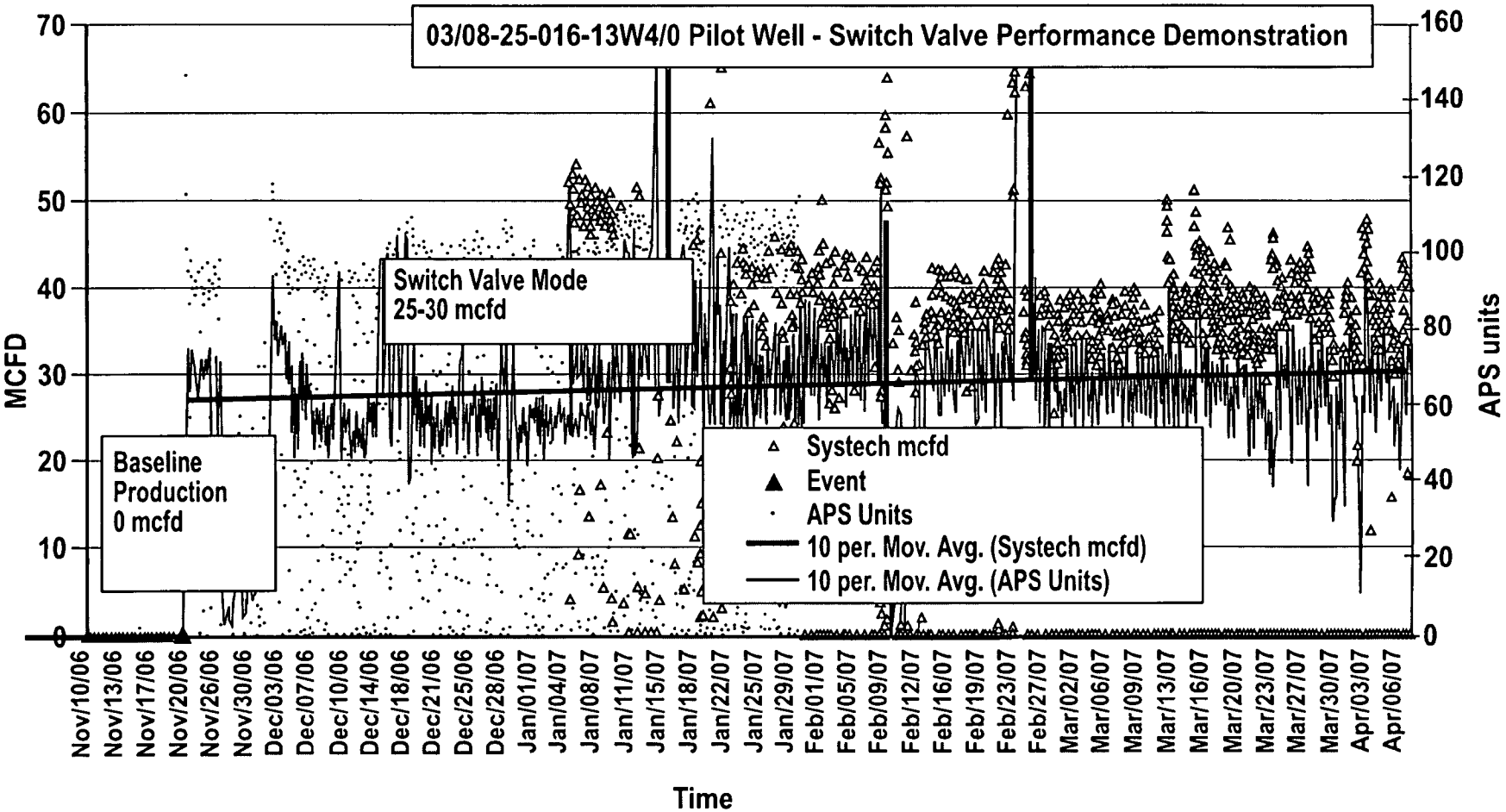
FIG. 5 is a graph presenting data collected from a pilot system illustrating the benefits of siphon string to switching valves production phase transition.

FIG. 5 is a graph of data taken from pilot systems in the Medicine Hat Area. In this graph it can be observed that the well produced through the siphon string at 20 MCFD aprox. and the PLC detected liquid loading at 17 MCFD. The controller initiated a cycling procedure that allowed the well to remove the water from the well bore. The controller resumed siphon string production once the system detected higher gas flow and less water production.

A description of these two methods is given in the book: Lea, J; Nickens, H; Wells, M: "Gas Well Deliquification". Elsevier, Burlington, Mass. 2003. p. 279-281, incorporated herein by reference.

Figure 6:
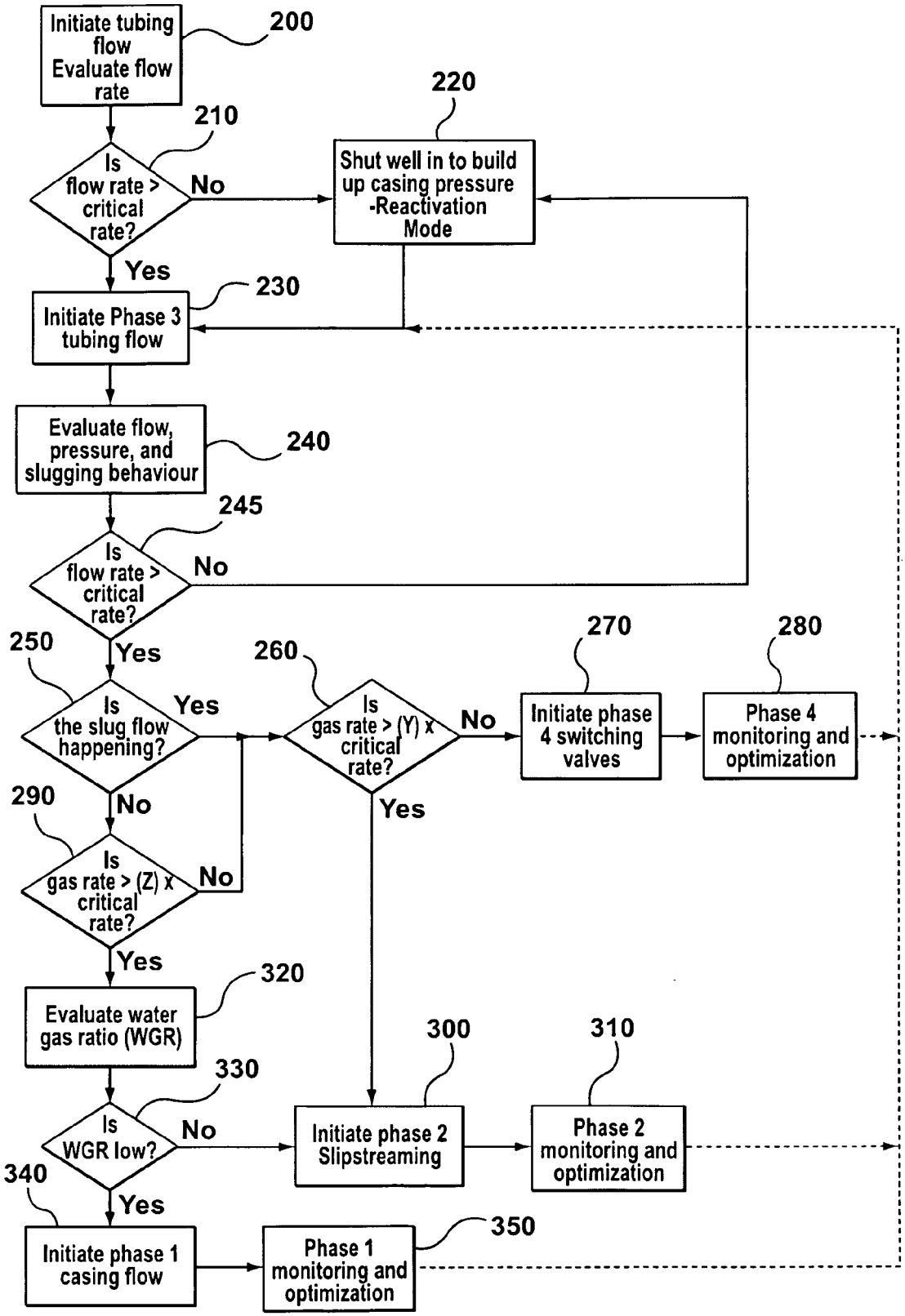
FIG. 6 is a flow chart illustrating an example of a method for operating a gas flow system.

FIG. 6 is a flow chart diagram illustrating an example of a method for operating a gas flow system such as a system as described above. Tubing flow is initiated and a gas flow rate up the tubing is evaluated in step 200. The evaluated flow rate is compared against a calculated critical flow rate in step 210. If the evaluated flow rate is less than the critical flow rate, the well goes into Reactivation Mode in step 220. During Reactivation Mode the well is shut in to build up a differential pressure (difference between casing pressure and pipeline pressure) that is greater than the flowing differential pressure. The well then goes into phase 3 in step 230 and the flow rate is monitored in step 240. In step 245, it is determined if the flow rate is greater than the critical flow rate. If the flow rate is not greater than the critical flow rate, the well returns to step 220 and will enter Reactivation Mode again and build up differential pressure to a higher level than on the previous attempt. This process is repeated until the well flows in phase 3 above the critical rate.

In an alternative embodiment, following step 220, the method may return to step 210 where the comparison between the evaluated flow rate and the calculated critical flow rate is carried out again. If the evaluated flow rate is greater than the critical rate, phase 3, as outlined above, is initiated in step 230.

While in phase 3, flow rate is evaluated, the pressures are measured and slugging behaviour is evaluated at step 240 to determine if the well is experiencing slug flow at step 250. Slug flow may be determined based on the average flow rate. For example, a 6 hour time interval where the slug flow evaluation is performed is discretized (broken up into smaller discrete time intervals of, for example 15 minutes). A 1 hour average of the peaks of the discrete time intervals is compared to the 6 hour average. If the average of these peaks is greater than 15% above the 6 hour average production, then slug flow can be assumed. The same is done with the low production values of the discrete time intervals. If the well is experiencing slug flow, the evaluated flow rate also referred to as gas rate is compared against a predetermined factor Y multiplied by the critical rate at step 260. If the gas rate is greater than Y multiplied by the critical rate, phase 2 slipstreaming, as outlined above, is initiated at step 300. If the gas rate is less than Y multiplied by the critical rate, phase 4 switching valves, as outlined above, is initiated at step 270. Once in either phase 2 or phase 4, the flow conditions of the well are monitored, in steps 310 and 280 respectively, and the current well conditions are evaluated to determine if a better phase for increased flow is available and the method returns to step 230. Optionally, after certain periods of time in phase 1, 2, or 4 the method, may automatically switch back to phase 3 and re-evaluate the well to determine a more suitable phase may be used. This switch back may be controlled by the PLC.

If slug flow is not occurring, as determined at step 250, the gas rate is compared against another predetermined factor Z (which typically differs from predetermined factor Y, but may be the same) multiplied by the critical rate at step 290. If the current gas rate is less than Z multiplied by the critical rate, method returns to step 260 where the current gas rate is compared against Y multiplied by the critical rate as outlined above. If the gas rate is greater than Z multiplied by the critical rate, the water gas ratio (WGR) is evaluated at step 320. At step 330, the WGR is compared to a predetermined WGR value, and if the WGR is below the predetermined WGR value, phase 1 casing flow with auto cleanout is initiated at step 340. If the WGR is not below the predetermined WGR value at step 330, phase 2 slipstreaming is initiated at step 300. Once in either phase 2 or phase 1, the flow conditions of the well are monitored, in steps 310 and 350 respectively, and the current well conditions are evaluated to determine if a better phase for increased flow is available and the method returns to step 230.

The WGR should be within a certain range so that the gas has enough energy to lift the water. If there is too much liquid for a given amount of gas, the gas will be unable to lift the water. If there is a large amount of gas, and not a lot of water (the favourable situation) the well will likely flow in phase 1 and produce the maximum amount of gas. A non-limiting example of a predetermined WGR value is 10. The WGR may be selected from possible WGR values of from about 5 to about 35 bbl/mmcf (barrels of liquid per million cubic feet of gas).

Y may be determined based on empirical (observed) data. A non-limiting example of a value for Y is 1 or 1.5. Z is related to the geometry of the well (casing and tubing size), but the specific value may be from empirical data. A non-limiting example of a value for Z is 2. The values for Y and Z may be between 1 and 2, but may also be outside of this range if the given gas well requires such a range.

As outlined above with reference to FIG. 1, a programmable logic controller may be used to evaluate conditions of the well and initiate any of the phases 1 to 4.

It is not essential to have a system or method that uses all four phases to achieve increased gas production in each well. As such, one skilled in the art will appreciate that the method may simply include any two or three phases as outlined above and may involve switching between 2 or more of the production phases described herein or another suitable production phase.

The present invention has been described with regard to a plurality of illustrative embodiments. However, it will be apparent to persons skilled in the art that a number of variations and modifications can be made without departing from the scope of the invention as defined in the claims.

We claim:

1. A method of dewatering a gas well while allowing for gas production, the gas well comprising:

a casing in the well bore for allowing flow of the liquid and gas;

a tubing string in the casing for allowing flow of the liquid and gas;

measurement devices for determining a rate of liquid influx into the well bore and a tubing critical velocity;

a casing control valve moveable between various positions ranging from fully open and fully closed for controlling flow through the casing;

a tubing control valve moveable between various positions ranging from fully open and fully closed for controlling flow through the tubing;

flow measurement devices for determining the rate of flow through the tubing and the total rate of flow;

the method comprising the steps of:

a) determining the rate of liquid influx into the well bore;

b) determining the critical tubing velocity and comparing the rate of flow through the tubing with the critical tubing velocity; and c) switching a current production phase to an alternate production phase if when the rate of flow through the tubing is above or below a specified velocity range encompassing the critical tubing velocity, or the rate of liquid influx is resulting in liquid build-up in the well bore;

wherein step c) further includes determining when slug flow is happening based on comparing an average of flow of a number of discrete times against an overall average of flow and when slug flow is happening:

iia) comparing the gas flow rate against a predetermined value Y multiplied by the critical rate and selecting a switching valves phase as the alternate production phase when the comparison shows the gas flow rate to be greater than the predetermined value Y multiplied by the critical rate or selecting a slipstreaming phase as the alternate phase when the comparison shows the gas flow rate to be less than the predetermined value Y multiplied by the critical rate;

or when slug flow is not happening:

iib) comparing the gas flow rate against a predetermined value Z multiplied by the critical rate and selecting the slipstreaming phase or the casing flow phase as the alternate production phase when the comparison shows the gas flow rate to be greater than the predetermined value Z multiplied by the critical rate; or comparing the gas flow rate against the predetermined value Y multiplied by the critical rate and selecting the switching valves phase as the alternate production phase when the comparison shows the gas flow rate to be greater than the predetermined value Y multiplied by the critical rate or selecting the slipstreaming phase as the alternate production phase when the comparison shows the gas flow rate to be less than the predetermined value Y multiplied by the critical rate.

2. The method of claim 1, wherein the steps a), b) and c) are carried out by a a-programmable logic controller (PLC) in communication with the measurement devices, the casing control valve, the tubing control valve and the flow measurement devices, the PLC adapted to determine the rate of liquid influx into the well bore and control the casing control valve and the tubing control valve to alternate the production phase between the current production phase and the alternate production phase.

3. The method of claim 1, wherein the current production phase and the alternate production phase are each selected from a group of possible production phases, the group of possible production phases consisting of: casing flow with auto cleanout, slipstreaming, siphon string/tubing flow and switching valves and wherein the current production phase is different from the alternate production phase.

4. The method of claim 1, wherein step iib) further comprises evaluating a water gas ratio (WGR) when the gas flow rate is greater than the predetermined value Z multiplied by the critical rate; and comparing the WGR to a WGR predetermined value and selecting the slipstreaming phase as the alternate production phase if the evaluated WGR is above the WGR predetermined value or the casing flow phase as the alternate production phase if the evaluated WGR is below the WGR predetermined value.

5. The method of claim 4, wherein the WGR is selected from between about 5 to about 35 bbl/mmcf.

6. The method of claim 1, wherein Z and Y are independently selected from a range of about 1.0 to 2.0.

* * * * *